US009552955B2

(12) United States Patent
Beckmann et al.

(10) Patent No.: US 9,552,955 B2
(45) Date of Patent: Jan. 24, 2017

(54) ELECTRON SOURCE

(75) Inventors: Moritz Beckmann, Cary, NC (US); Walter Beyerlein, Bubenreuth (DE); Andreas Böhme, Nürnberg (DE); Yuan Cheng, Cary, NC (US); Jens Fürst, Herzogenaurach (DE); Markus Hemmerlein, Neunkirchen/Br (DE); Houman Jafari, Cary, NC (US); Jürgen Oelschlegel, Nürnberg (DE); Qi Qiu, Cary, NC (US); Frank Sprenger, Cary, NC (US)

(73) Assignees: SIEMENS HEALTHCARE GMBH, Erlangen (DE); NURAY TECHNOLOGY CO, LTD., Changzhou (CN)

( * ) Notice: Subject to any disclaimer, the term of this patent is extended or adjusted under 35 U.S.C. 154(b) by 498 days.

(21) Appl. No.: 13/291,080

(22) Filed: Nov. 7, 2011

(65) Prior Publication Data

US 2012/0286692 A1 Nov. 15, 2012

(30) Foreign Application Priority Data

Nov. 8, 2010 (DE) ..... 10 2010 043 561

(51) Int. Cl.

| | |
|---|---|
| ***H05B 41/36*** | (2006.01) |
| ***H01J 35/06*** | (2006.01) |
| ***H01J 3/02*** | (2006.01) |
| ***H05G 1/26*** | (2006.01) |
| ***H05G 1/32*** | (2006.01) |
| ***H05G 1/48*** | (2006.01) |

(Continued)

(52) U.S. Cl.

CPC ..... *H01J 35/065* (2013.01); *H01J 3/021* (2013.01); *H05G 1/265* (2013.01); *H05G 1/32* (2013.01); *H05G 1/48* (2013.01); *H05G 1/58* (2013.01); *H05G 1/70* (2013.01); *H01J 2235/068* (2013.01)

(58) Field of Classification Search

CPC ..... H01J 35/14; H01J 35/06; H01J 35/065; H01J 35/025; H01J 2235/186; H01J 35/00; H01J 2235/068; H01J 3/021; H05G 1/265; H05G 1/32; H05G 1/48; H05G 1/58; H05G 1/70; H05B 41/36; H05B 41/30; G09G 3/22

USPC ..... 315/381, 106, 107, 111.81, 291, 11.81,315/307, 308; 313/309, 336, 351; 378/136, 119

See application file for complete search history.

(56) References Cited

U.S. PATENT DOCUMENTS

| | | | | |
|---|---|---|---|---|
| 3,963,931 | A | 6/1976 | Shapiro | |
| 4,734,924 | A | 3/1988 | Yahata et al. | |
| 5,386,172 | A * | 1/1995 | Komatsu | 313/309 |

(Continued)

FOREIGN PATENT DOCUMENTS

| | | |
|---|---|---|
| DE | 36 35 133 A1 | 4/1987 |
| DE | 10 2009 003 673 A1 | 10/2009 |

(Continued)

OTHER PUBLICATIONS

German Office Action dated Jul. 26, 2011 for corresponding German Patent Application No. DE 10 2010 043 561.9 with English translation.

*Primary Examiner* — Jimmy Vu

(74) *Attorney, Agent, or Firm* — Lempia Summerfield Katz LLC

(57) ABSTRACT

An electron source includes a plurality of electron emission cathodes and at least one control electrode. A gate current (Continued)

regulator is provided for regulation of current flowing through the at least one control electrode.

15 Claims, 3 Drawing Sheets

(51) Int. Cl.
*H05G 1/58* (2006.01)
*H05G 1/70* (2006.01)

(56) References Cited

U.S. PATENT DOCUMENTS

| | | | | |
|---|---|---|---|---|
| 2002/0145396 | A1* | 10/2002 | Gordon et al. | 315/368.16 |
| 2009/0058319 | A1* | 3/2009 | Berk et al. | 315/291 |
| 2010/0260317 | A1* | 10/2010 | Chang et al. | 378/62 |
| 2014/0346975 | A1* | 11/2014 | Jeong | H01J 1/304 315/308 |

FOREIGN PATENT DOCUMENTS

| | | | |
|---|---|---|---|
| DE | 10 2007 042 108 | B4 | 2/2010 |
| DE | 10 2009 011 642 | A1 | 9/2010 |
| DE | 10 2009 017 649 | A1 | 10/2010 |

* cited by examiner

ELECTRON SOURCE

This application claims the benefit of DE 10 2010 043 561.9, filed on Nov. 8, 2010.

BACKGROUND

The present embodiments relate to an electron source and a method for the operation of an electron source.

An electron source that may be used in an X-ray tube of an imaging medical engineering device is, for example, known from DE 10 2007 042 108 B4. The electron source includes electron emission cathodes and a plurality of control electrodes. An electrically insulating data transmission link (e.g., an optical data transmission link) is provided for data transmission between a high-voltage unit provided for supplying energy to the electron source, and a low-voltage unit.

Electron sources in multifocus X-ray tubes with control electrodes constructed, for example, as grids may work with field emitters such as carbon nanotube (CNT)-emitters based on CNTs or thermal emitters. The principle of an electron source with CNTs is known, for example, from DE 10 2009 003 673 A1.

The emission of electrons is determined by an electrical filed strength on a surface of the electron emission cathode and may be set by a voltage applied at a grid-like control electrode (e.g., a control grid). The relationship between the voltage and the generated electron current may be described by an exponential characteristic curve. Over the lifetime of an electron source, the exponential characteristic curve is subject to changes. The changes in the exponential characteristic curve have origins, for example, in damage to and/or aging of the electron emission cathodes and may be offset by a regulator that adjusts the control voltage (e.g., the voltage applied between the electron emission cathodes currently in operation and the control grid).

In an X-ray tube, the electrons emitted by the electron emission cathodes are accelerated to an energy necessary to generate the X-ray radiation by the high voltage applied to the anode of the X-ray tube. The electrons arriving at the anode define the tube or anode current. This depends on, among other factors, a geometric arrangement of individual components within the X-ray tube, on the control voltage, and on numerous other influencing values (e.g., temperatures of components of the electron source such as a temperature of the electron emission cathodes, an on-time of the X-ray tube, the cathode current and a vacuum level within the X-ray tube). In addition, the operation of the X-ray tube to date (e.g., a history of the X-ray tube) may influence a dose-determining tube stream. For example, the control grid used and an operating state of the control grid influences the tube stream.

The anode current determining the X-ray dose may be produced from the cathode current minus a current flowing out via the control electrode. The relationship of anode current to cathode current is defined as a transmission rate and may be determined, for example, with the aid of a learning procedure. The transmission rate determined may be assumed to be constant or at least only slowly changeable. Measurement of the cathode current is thus suitable for determining a generated dose of X-ray radiation. This measurement may, for example, take place via a measuring resistor. As a result of capacitive loads in the measurement arrangement implemented in the control electronics of the X-ray tube, limitations of this measurement principle do, however, exist in the case of rapid switching procedures.

In order to determine the dose of generated X-ray radiation based on the release of electrons by the electron emission cathodes, two interrelationships are thus, for example, to be considered: the characteristic curve of the electron source and the transmission rate of the X-ray tube.

An electron source may be regulated by a voltage regulation. The current/voltage characteristic curve of each electron emission cathode may be determined with the aid of a learning procedure. Current values assigned to the voltage values are stored in a table for each of the individual electron emission cathodes. The tables, which represent characteristic curves of the electron emission cathodes, remain unchanged. Thus, aging or drifting of electron emission cathodes is also ignored, as is the case with changes in the transmission rate.

Given sufficiently long pulses (e.g., from around 1 ms), the aging and drifting may be offset by an overlaid current regulation, in that the set value specified is readjusted for the voltage. However, in the course of the readjustment, charge transfers that adversely affect the cathode current take place. In the case of small anode currents, capacitive currents have an effect on the measurement in a relevant manner.

Capacitive charge transfer effects, for example, restrict the applicability of the overlaid current regulation in the case of short pulses. As a result of these charge transfer effects, an estimation of the anode current may only be possible after approximately 40 μs on the cathode side. A prerequisite for a readjustment is thus a significantly longer pulse duration. A direct measurement and regulation of the dose-determining anode current, which may come into consideration instead of a cathode side measurement and regulation, is, however, not possible with pulse durations of the aforementioned order of magnitude according to the prior art. Measurement of the anode currents may thus take place in the generator at low potential at a generator low end. Strong low pass filtering is used in order to avoid disturbing variables. Time constants thus supplied may lie in the order of 70 μs, which corresponds to an order of magnitude of a desired, short pulse duration.

SUMMARY AND DESCRIPTION

The present embodiments may obviate one or more of the drawbacks or limitations in the related art. For example, precise and rapid control and regulation of an electron source may be provided.

Embodiments and advantages explained below in connection with the electron source also apply to the method, and vice versa.

The electron source includes a plurality of electron emission cathodes and at least one control electrode. The electron source also includes a gate current regulator configured for regulation of the current flowing through the at least one control electrode. A value (e.g., gate current) that is proportional to a dose-determining anode current in an X-ray tube may be influenced.

The gate current regulator is part of a control loop that also includes an actuator and a gate current determining unit. The gate current regulator enables very rapid regulation. For example, a stationary status is very rapidly reached, as a result of which, the gate current regulation is suited to pulse durations under 0.1 ms (e.g., pulse durations of 70 μs). A current measured at a shunt resistor on the gate side has no unavoidable, capacitive current, according to the prior art (e.g., as described above) and thus directly represents the gate current.

The measurement and regulation of the gate current enables an overlaid regulation, in which the dose-determining Strom in an X-ray tube is determined by substraction of the gate current from the cathode current. If applicable, variances of the transmission rate from the stored value may be offset by an overlaid control loop. The overlaid regulation may take place relatively slowly by comparison with the direct gate current regulation, since only small variances occur, and the transmission rate changes slowly. By storing the variance under steady-sate conditions and already taking account of the variance for the following electron emission of the pulsed operated cathode, a precise anode current is generated with a high level of reproducibility.

The voltage at the control electrode (e.g., the gate potential) may amount to up to 5 kV, which, compared, for example, to a possible measurement of the anode current, enables a relatively simple and highly dynamic measurement of the gate current. A discrete buffer amplifier may be used for this measurement. However, limitations in relation to the bandwidth are to be taken into account.

In order to provide a high bandwidth, measurement of the gate current may, for example, take place with the aid of a substraction circuit for high voltages, with an operational amplifier switched to high impedance.

In one embodiment, for measurement of the gate current, a measuring unit with paired opto-couplers (e.g., a measurement coupler and a reference coupler) may be provided.

In one embodiment, the gate current may be measured using a shunt, a high-speed analog-to-digital converter, an auxiliary power supply at gate potential, and a transfer of the digital signal via optical fiber or opto-coupler.

The area of application of the gate current regulation may be multi-cathode X-ray tubes. Electron emission cathodes may be configured as field emitters or thermal emitters. The field emitters may be realized on the basis of carbon nanotubes (CNT) or based on graphene. Alternatively, dispenser cathodes are provided. A single control grid, arranged at a small distance therefrom, is assigned to a number of electron emission cathodes. The grid may be segmented. The segments may be controlled individually.

The advantage of the present embodiments may lie, for example, in the fact that a value (e.g., the gate current) is regulated independently of the aging and drift effects in an X-ray, which is directly proportional to the dose-determining current. No capacitive disturbing variables occur, so that even in the case of very short pulses and a change in the emission behavior of the electron emission cathodes, regulation with the maximum reproducibility is delivered. In the case of short pulses, specified in mAs, an accurate mAs cutoff may be realized.

DETAILED DESCRIPTION OF THE DRAWINGS

Figure 1:
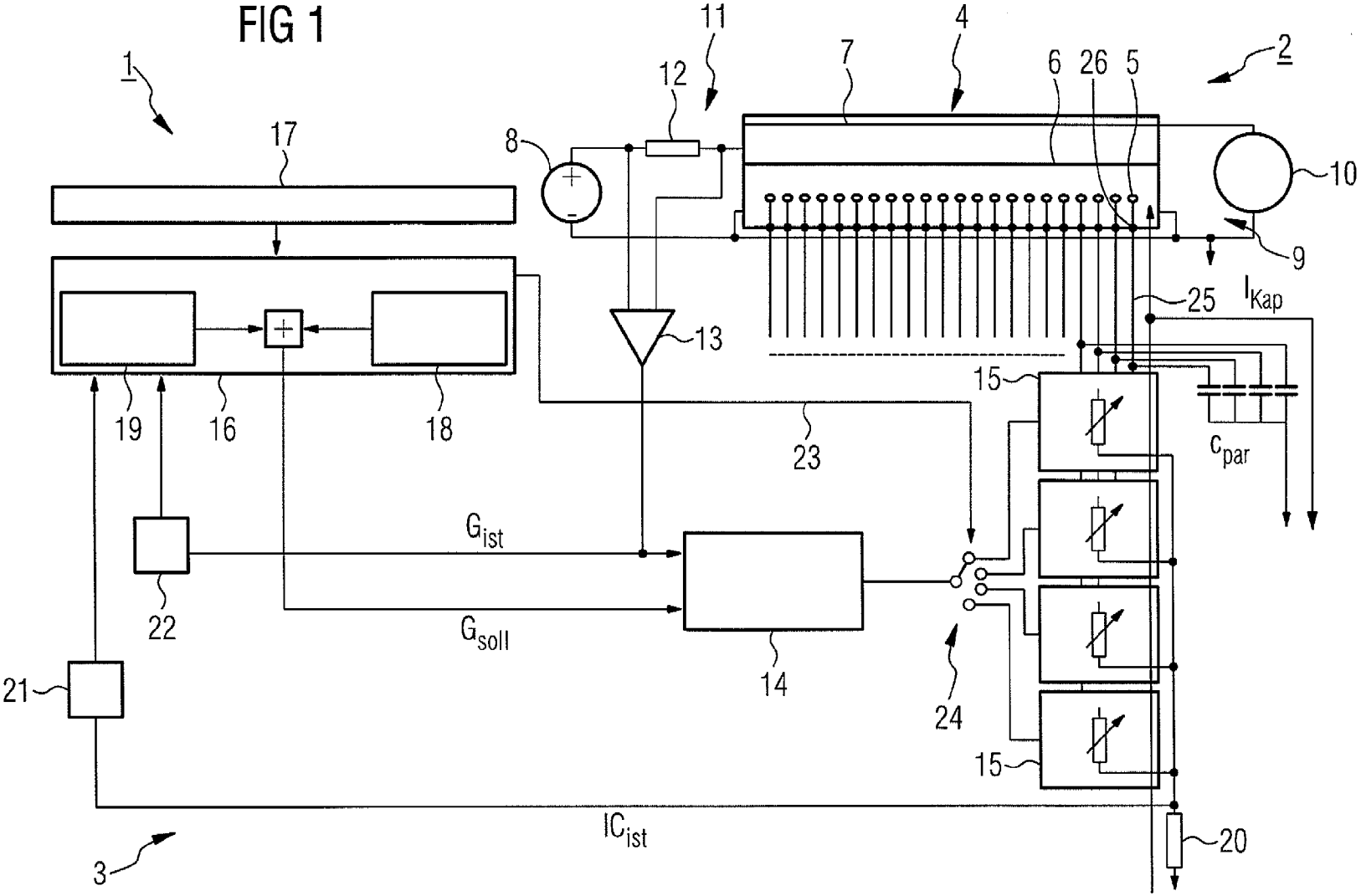
FIG. 1 shows one embodiment of an electron source with gate current regulation.

FIG. 1 shows one embodiment of an X-ray device that includes an X-ray tube 2 and a control unit 3. The X-ray device is identified overall with the reference character 1.

The X-ray tube 2 includes a tube unit 4 that includes a plurality of electron emission cathodes 5, a control grid 6 (e.g., a control electrode), and an anode 7. With respect to the basic function of the tube unit 4 (e.g., actual tubes of the X-ray device 1), attention is drawn to the prior art cited in the introduction, and to DE 10 2009 011 642 A1.

In one embodiment, the plurality of electron emission cathodes 5 is configured as field emitters and emits electrons using field emission. A voltage of up to 5 kV is applied between the plurality of electron emission cathodes 5 and the control grid 6 using a grid voltage supply 8. The arrangement including the plurality of electron emission cathodes 5, the control grid 6, and the grid voltage supply 8 is configured as an electron source 9. Individual electron emission cathodes 5 or groups of electron emission cathodes 5 of the plurality of electron emission cathodes may be controlled separately, so that geometrical parameters of the electron source 9 and thus also the generated X-ray radiation may be changed without changing the arrangement of the electron source 9 (e.g., through shifting of the electron source 9).

X-ray radiation is generated in the tube unit 4 in that electrons emitted by the electron source 9 are accelerated using high voltage that may be in the order of 20 kV to 180 kV. The high voltage is generated by a high voltage supply unit 10 and applied between the plurality of electron emission cathodes 5 and the anode 7. The high voltage arrives at the anode 7. Electron current released from the plurality of electron emission cathodes 5 (e.g., cathode current) divides into two partial currents:

A first partial current (e.g., gate current (IG)) flows out via the control grid 6; a second partial current reaches the anode 7 in order to generate X-ray radiation at the anode 7. The second partial current is designated an anode current (IA). The relationship between the anode current (IA) and the cathode current (IK) is defined as a transmission rate (TR) of the X-ray tube 2. The following relationship exists between the gate current (IG), the anode current (IA), and the transmission rate (TR):

$$IG=IA\times(1-TR)/TR$$

A gate current measuring unit 11 is provided for measuring the gate current, which, as shown in simplified form in FIG. 1, includes, for example, a shunt 12 and an operational amplifier 13. An auxiliary power supply for the gate current measuring unit 11 may be integrated into the grid voltage supply 8. The gate current measuring unit 11 is part of a control loop, which further includes a gate current regulator 14 and a number of actuators 15 that are each assigned to an electron emission cathode 5 of the plurality of electron emission cathodes 5. The gate current is regulated at the control loop via a voltage difference between gate (6) and cathode (5), according to the above formula.

The gate current regulator 14 is connected to a microcontroller 16. The microcontroller 16, among other functions, processes set values for radiation parameters that are stored in a memory 17. A gate current supply 18 implemented in the microcontroller 16, which prescribes a nominal value of the gate current (e.g., may be calculated according to the formula above), interacts with an anode current readjustment unit 19 (e.g., likewise realized in the microcontroller 16) in order to prescribe a set value of the gate current ($G_{soll}$) for the gate current regulator 14. An actual value of the gate current is accordingly designated $G_{ist}$. The actual value of the cathode current $IC_{ist}$ processed by the anode current readjustment unit 19 is measured with the aid of a shunt 20 and digitized by an analog-to-digital converter 21. A further analog-to-digital converter 22, which interacts with the anode current readjustment unit 19, is provided for digitization of the actual value of the gate current $G_{ist}$. The analog-to-digital converter 21 and the further analog-to-digital converter 22 may be integrated into the anode current readjustment unit 19. The anode current readjustment unit 19, for example, takes account of long-term, creeping changes in the transmission rate of the X-ray tube 2.

The microcontroller 16 enables a targeted selection of, for example, up to several hundred electron emission cathodes 5 and interacts with a contactor 24 via a control line 23. The contactor 24 is connected between the gate current regulator 14 and the actuator 15. Each electron emission cathode 5 of the plurality of electron emission cathodes 5 is connected to the associated actuator 15 via a cathode line 25 and a vacuum feedthrough 26. Cathode-side parasitic capacitances are designated $C_{par}$, and corresponding currents are designated with $I_{Kap}$. The regulation of the gate current using the gate current measuring unit 11, the gate current regulator 14 and the actuators 15 is not influenced by the parasitic capacitances $C_{par}$; the actual value of the gate current $IG_{ist}$ is measured without falsification.

Figure 2:
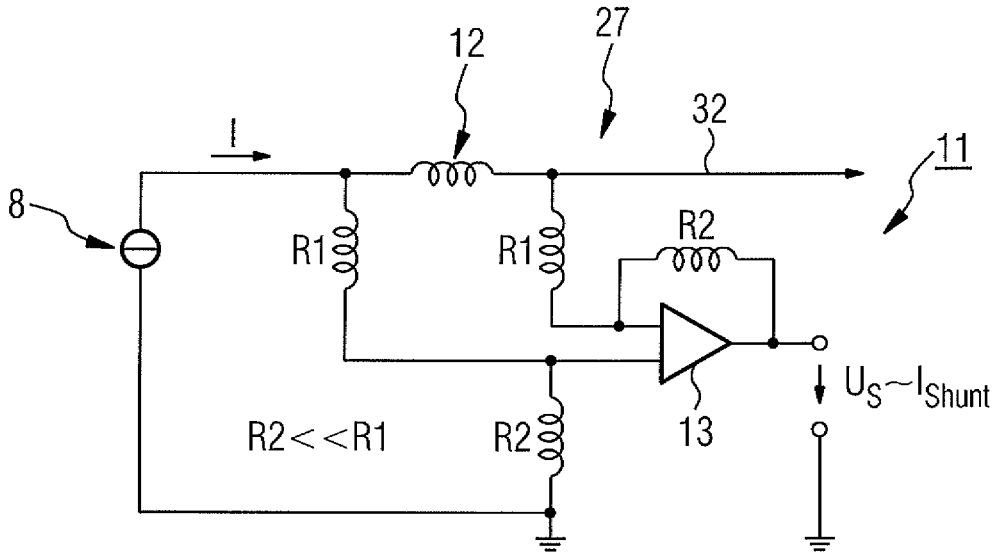
FIGS. 2-4 show variants of a gate current measuring unit for the electron source according to FIG. 1.
Figure 3:
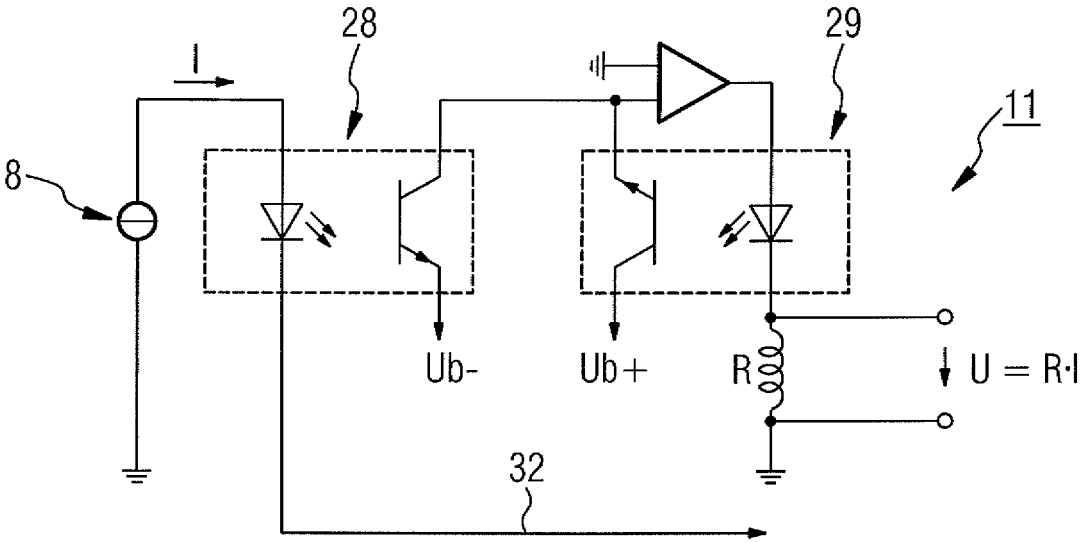
Figure 4:
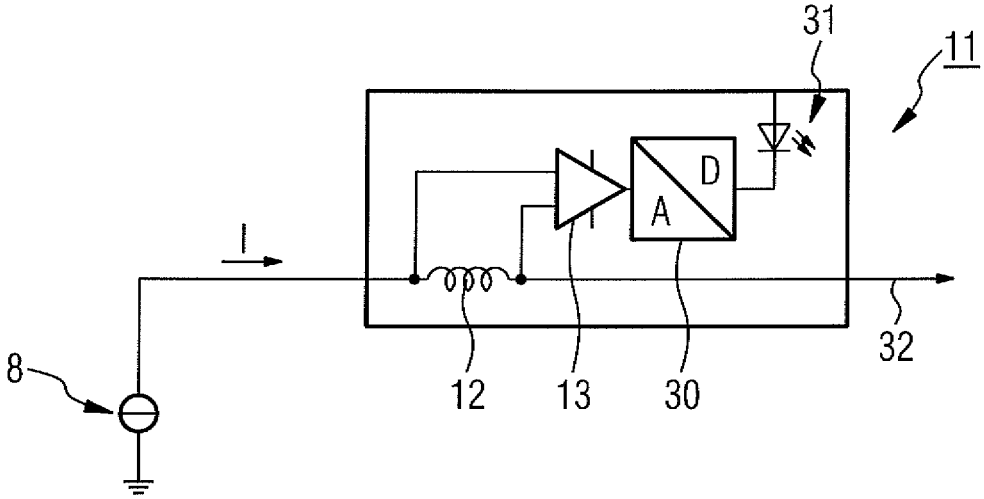

Different possible ways of configuring the gate current measuring unit 11 for a precise, rapid measurement of the gate current are represented in FIGS. 2 to 4.

In the exemplary embodiment according to FIG. 2, the gate current measuring unit 11 includes a substraction circuit 27 for high voltages. The operational amplifier 13, which is also shown in simplified form in FIG. 1, is switched to high impedance using different resistances R1, R2. A measured voltage $U_S$ is proportional to the current flowing through the shunt 12 $I_{Shunt}$.

According to the embodiment shown in FIG. 3, paired opto-couplers 28, 29 are provided within the gate current-measuring unit 11. The opto-couplers function as measurement couplers or as reference couplers.

In the variant according to FIG. 4, measurement of the gate current takes place via the shunt 12, the operational amplifier 13, and a fast analog-to-digital converter 30 connected downstream of the shunt 12 and the operational amplifier 13. The fast analog-to-digital converter 30 supplies a digital signal. The supplied digital signal is fed to the gate current regulator 14 by an opto-coupler 31 or optical fiber.

In each of the FIGS. 2 to 4, a line connected to the control grid 6, conducting the directly regulated gate current, is identified with the reference character 32. In each of the FIGS. 2 to 4, the gate current and thus, taking account of short- and long-term influences, the anode current may be precisely regulated from 70 μs.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A system for regulating an electron source, the system comprising:

a plurality of electron emission cathodes operable to release a current;

at least one control electrode;

a gate current regulator configured for regulation of a gate current flowing through the at least one control electrode via a voltage difference between the at least one control electrode and an electron emission cathode of the plurality of electron emission cathodes; and a gate current measuring unit in a control loop including the gate current regulator, the gate current measuring unit operable to measure the gate current, the gate current being a portion of the current released by the plurality of electron emission cathodes, wherein an electron current of at least one electron emission cathode of the plurality of electron emission cathodes is proportional to the gate current.

2. The system as claimed in claim 1, wherein the gate current measuring unit has a substraction circuit in the control loop.

3. The system as claimed in claim 1, wherein the gate current-measuring unit comprises paired opto-couplers.

4. The system as claimed in claim 1, wherein the gate current-measuring unit comprises a shunt, an analog-to-digital converter, and an opto-coupler.

5. The system as claimed in claim 1, wherein the plurality of electron emission cathodes is configured as field emitters or indirectly heated emitters.

6. The system as claimed in claim 5, wherein the plurality of electron emission cathodes comprises carbon nanotubes or graphene or is configured as dispenser cathodes.

7. The system as claimed in claim 2, wherein the plurality of electron emission cathodes is configured as field emitters or indirectly heated emitters.

8. The system as claimed in claim 3, wherein the plurality of electron emission cathodes is configured as field emitters or indirectly heated emitters.

9. The system as claimed in claim 4, wherein the plurality of electron emission cathodes is configured as field emitters or indirectly heated emitters.

10. A method for the operation of an electron source, the method comprising:

emitting electrons with a plurality of electron emission cathodes, wherein a voltage is applied between the plurality of electron emission cathodes and a control electrode;

regulating, with a gate current regulator, gate current flowing through the control electrode via the voltage applied between an electron emission cathode of the plurality of electron emission cathodes and the control electrode; and measuring the gate current with a gate current measuring unit in a control loop including the gate current regulator, the gate current comprising a portion of the electrons emitted by the plurality of electron emission cathodes, wherein an electron current of at least one electron emission cathode of the plurality of electron emission cathodes is proportional to the gate current.

11. The method as claimed in claim 10, wherein the plurality of electron emission cathodes is operated is a pulsed manner, with pulse times under 1 ms.

12. The method as claimed in claim 10, further comprising determining a transmission rate of the electron source, wherein the determining comprises subtracting the gate current flowing through the control electrode from a cathode current flowing through the plurality of electron emission cathodes.

13. The method as claimed in claim 12, wherein a change in the transmission rate is incorporated into the regulation of the gate current.

14. The method as claimed in claim 11, wherein the pulse times are under 0.1 ms.

15. The method as claimed in claim 11, further comprising determining a transmission rate of the electron source, wherein the determining comprises subtracting the gate current flowing through the control electrode from a cathode current flowing through the plurality of electron emission cathodes.

* * * * *